US008485864B2

(12) United States Patent
Furukawa

(10) Patent No.: US 8,485,864 B2
(45) Date of Patent: Jul. 16, 2013

(54) DOUBLE-SIDE POLISHING APPARATUS AND METHOD FOR POLISHING BOTH SIDES OF WAFER

(75) Inventor: Masanori Furukawa, Nagano (JP)

(73) Assignee: Fujikoshi Machinery Corp., Nagano (JP)

( * ) Notice: Subject to any disclaimer, the term of this patent is extended or adjusted under 35 U.S.C. 154(b) by 365 days.

(21) Appl. No.: 12/788,902

(22) Filed: May 27, 2010

(65) Prior Publication Data

US 2010/0311312 A1 Dec. 9, 2010

(30) Foreign Application Priority Data

Jun. 3, 2009 (JP) ..... 2009-134449

(51) Int. Cl.
*B24B 41/06* (2012.01)
*B24B 29/04* (2006.01)
*B24B 1/00* (2006.01)

(52) U.S. Cl.
USPC ..... 451/41; 451/262; 451/269; 451/398

(58) Field of Classification Search
USPC ..... 451/262, 268, 269, 270, 397, 398, 451/400, 402, 41, 63
See application file for complete search history.

(56) References Cited

U.S. PATENT DOCUMENTS

| | | | | |
|---|---|---|---|---|
| 5,085,009 | A * | 2/1992 | Kinumura et al. | 451/291 |
| 5,964,651 | A * | 10/1999 | Hose | 451/262 |
| 6,030,280 | A * | 2/2000 | Fruitman | 451/291 |
| 6,042,688 | A * | 3/2000 | Masumura et al. | 156/345.14 |
| 6,080,048 | A * | 6/2000 | Kotagiri et al. | 451/285 |
| 6,089,959 | A * | 7/2000 | Nagahashi | 451/262 |
| 6,454,635 | B1 * | 9/2002 | Zhang et al. | 451/41 |
| 6,514,424 | B2 * | 2/2003 | Wenski et al. | 216/38 |
| 6,579,160 | B2 * | 6/2003 | Nanjo et al. | 451/291 |
| 7,004,827 | B1 * | 2/2006 | Suzuki et al. | 451/285 |
| 7,008,308 | B2 * | 3/2006 | Bjelopavlic et al. | 451/269 |
| 7,364,495 | B2 * | 4/2008 | Tominaga et al. | 451/41 |
| 7,485,029 | B2 * | 2/2009 | Kanda et al. | 451/267 |
| 2005/0202758 | A1 * | 9/2005 | Yoshida et al. | 451/41 |
| 2006/0178094 | A1 * | 8/2006 | Miyashita et al. | 451/262 |
| 2008/0166952 | A1 * | 7/2008 | Ueno | 451/41 |
| 2009/0104852 | A1 * | 4/2009 | Pietsch et al. | 451/41 |
| 2009/0203300 | A1 | 8/2009 | Yoshida et al. | |

FOREIGN PATENT DOCUMENTS

| | | | |
|---|---|---|---|
| DE | 10247200 | A1 * | 4/2004 |
| EP | 776030 | A2 * | 5/1997 |
| JP | 09207064 | A * | 8/1997 |
| JP | 11129156 | A * | 5/1999 |
| JP | 11-254305 | A | 9/1999 |

(Continued)

*Primary Examiner* — Lee D Wilson
*Assistant Examiner* — Tyrone V Hall, Jr.
(74) *Attorney, Agent, or Firm* — Birch, Stewart, Kolasch & Birch, LLP

(57) ABSTRACT

The double-side polishing apparatus is capable of uniformly polishing a wafer and highly preventing an outer edge of the wafer from being damaged. The apparatus comprises: a lower polishing plate and an upper polishing plate for polishing both sides of the wafer; a carrier having a main body part, in which a through-hole for holding the wafer is formed. Edges of the through-hole in an upper face and a lower face of the carrier are coated with coating layers, which are composed of an abrasion-resistant material and which have a prescribed width and a prescribed thickness. A resin cushion ring, which has a prescribed width and whose thickness is equal to that of the main body part of the carrier, is provided to an inner circumferential face of the thorough-hole. The wafer is held in the resin cushion ring.

2 Claims, 10 Drawing Sheets

FOREIGN PATENT DOCUMENTS

| | | | | |
|---|---|---|---|---|
| JP | 2002018707 | A | * | 1/2002 |
| JP | 2005-254351 | A | | 9/2005 |
| JP | 2006026760 | A | * | 2/2006 |
| JP | 2006108125 | A | * | 4/2006 |

* cited by examiner

DOUBLE-SIDE POLISHING APPARATUS AND METHOD FOR POLISHING BOTH SIDES OF WAFER

CROSS-REFERENCE TO RELATED APPLICATION

This application is based upon and claims the benefit of priority of the prior Japanese Patent Application No. P2009-134449, filed on Jun. 3, 2009, and the entire contents of which are incorporated herein by reference.

FIELD

The present invention relates to a double-side polishing apparatus and a method for polishing both sides of wafer.

BACKGROUND

In case of polishing both sides of a semiconductor wafer, a carrier whose thickness is equal to that of a finished wafer is used to restrain subduction of polishing cloth while the polishing operation is performed, so that a mirror-surface wafer, which has superior flatness and whose outer edges are not rounded, can be produced.

However, when the thickness of the wafer reaches the finished thickness, the polishing cloth contacts the carrier. By the contact, the carrier is abraded and its thickness is reduced, so the carrier must be frequently exchanged. Of course, the abraded carrier cannot be reused. Further, when the thickness of the wafer reaches the finished thickness, the polishing cloth contacts the entire wafer and carrier, so abrasion resistance is increased. Therefore, a great load is applied to the polishing apparatus and a high power driving source is required.

A conventional technology for solving the above described problems is disclosed in Japanese Laid-open Publication No. 11-254305A. In this technology, a thickness adjusting member is provided to an edge part of a through-hole (a wafer holding hole) of a carrier so as to make a thickness of the edge part of the through-hole thicker than that of a main body part of the carrier. With this structure, the finished thickness of the wafer can be adjusted. Further, when the thickness adjusting member is abraded, it can be exchanged so that abrasion of the main body part of the carrier can be prevented and the above described problems can be solved.

However, in the above described conventional technology disclosed in the Japanese Laid-open Publication No. 11-254305, the thickness adjusting member is provided to the edge part of the through-hole. A thickness of the outer edge of the finished wafer, which is located just inside of the thickness adjusting member, must be thicker than the center part the finished wafer, and flatness of the finished wafer must be bad. Further, the outer edge of the wafer collides with an inner circumferential face of the through-hole of the carrier and is prone to be damaged.

SUMMARY

Accordingly, it is an object in one aspect of the invention to provide a double-side polishing apparatus and a method for polishing both sides of a wafer, which are capable of uniformly polishing the wafer and highly preventing an outer edge of the wafer from being damaged.

To achieve the object, a first basic structure of the double-side polishing apparatus of the present invention comprises:

a lower polishing plate having an upper face, on which polishing cloth is adhered;

an upper polishing plate being provided above the lower polishing plate and capable of being moved upward and downward, the upper polishing plate having a lower face, on which polishing cloth is adhered;

a carrier being provided between the lower polishing plate and an upper polishing plate, the carrier having a main body part, in which a through-hole for holding a wafer is formed;

a plate driving unit for rotating the lower polishing plate and the upper polishing plate about their axial lines;

a carrier driving unit for rotating the carrier; and a slurry supply source, the lower polishing plate, the upper polishing plate and the carrier are rotated, with supplying slurry onto the lower polishing plate, so as to polish both sides of the wafer which is sandwiched between the lower polishing plate and the upper polishing plate, edges of the through-hole in an upper face and a lower face of the carrier are coated with coating layers, which are composed of an abrasion-resistant material and which have a prescribed width and a prescribed thickness, a resin cushion ring, which has a prescribed width and whose thickness is equal to that of the main body part of the carrier, is provided to an inner circumferential face of the thorough-hole, and the wafer is held in the resin cushion ring.

Next, a second basic structure of the double-side polishing apparatus of the present invention comprises:

a lower polishing plate having an upper face, on which polishing cloth is adhered;

an upper polishing plate being provided above the lower polishing plate and capable of being moved upward and downward, the upper polishing plate having a lower face, on which polishing cloth is adhered;

a carrier being provided between the lower polishing plate and an upper polishing plate, the carrier having a main body part, in which a plurality of through-holes for holding wafers are formed;

a plate driving unit for rotating the lower polishing plate and the upper polishing plate about their axial lines;

a carrier driving unit for rotating the carrier; and a slurry supply source, the lower polishing plate, the upper polishing plate and the carrier are rotated, with supplying slurry onto the lower polishing plate, so as to polish both sides of the wafers which are sandwiched between the lower polishing plate and the upper polishing plate, the through-holes are equally spaced in the circumferential direction of the carrier, and a part of an edge of each through-hole is close to an edge of the main body part of the carrier, a lower edge part and an upper edge part of the carrier, which include the parts of the edges of the through-holes, are coated with coating layers, which are composed of an abrasion-resistant material and which have a prescribed width and a prescribed thickness, resin cushion rings, which have a prescribed width and whose thickness is equal to that of the main body part of the carrier, are respectively provided to inner circumferential faces of the thorough-holes, and the wafers are respectively held in the resin cushion rings.

Further, the method of the present invention is performed in the double-side polishing apparatus of the present invention, and the polishing operation is stopped when the thickness of the wafer reaches a prescribed thickness range, which is from a thickness equal to that of the main body part of the carrier to a thickness equal to a distance between the coating layer in the upper face of the main body part and the coating layer in the lower face thereof.

In the present invention, the good flatness wafer, whose upper and lower edges are moderately erected without being rounded, can be produced.

By employing the cushion ring, damaging the edges of the wafer can be highly prevented.

Further, the coating layers are composed of the abrasion-resistant material, so that a span of life of the carrier can be extended.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF THE DRAWINGS

Embodiments of the present invention will now be described by way of examples and with reference to the accompanying drawings, in which.

DESCRIPTION OF THE EMBODIMENTS

Preferred embodiments of the present invention will now be described in detail with reference to the accompanying drawings.

Figure 1:
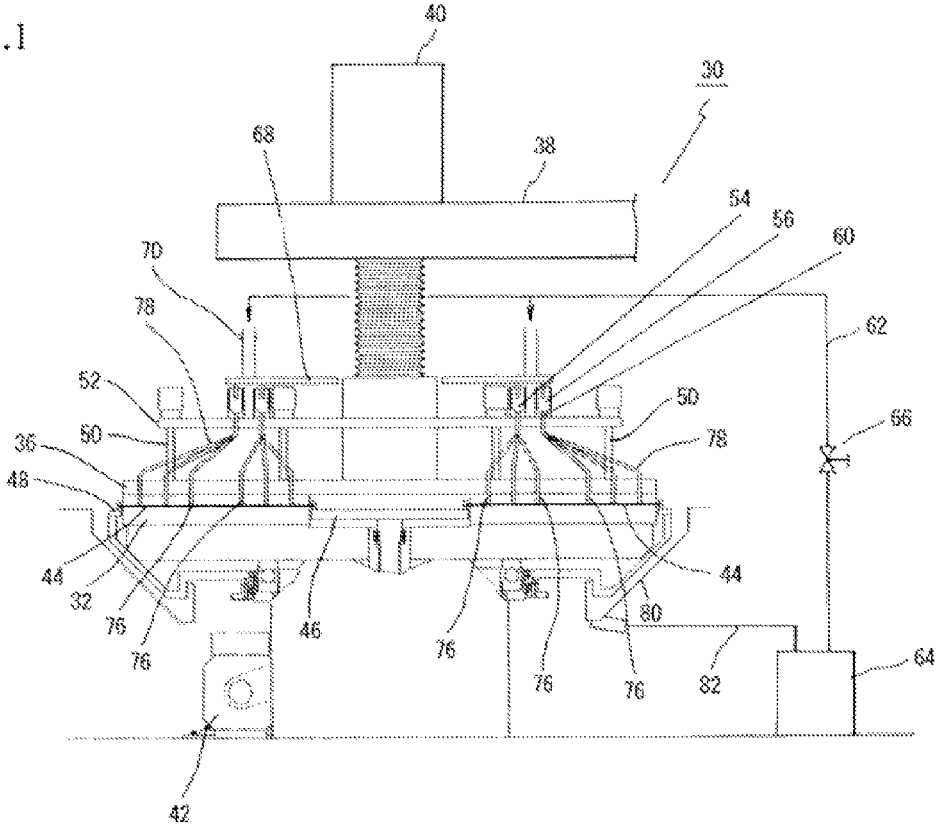
FIG. 1 is a front view of an embodiment of a double-side polishing apparatus of the present invention.

FIG. 1 is an explanation view showing a front view of an embodiment of a double-side polishing apparatus 30. A known basic structure may be employed in the double-side polishing apparatus 30, so an outline of the double-side polishing apparatus 30 will be explained.

The double-side polishing apparatus 30 has a lower polishing plate 32, whose upper face is a polishing face, and an upper polishing plate 36, which is located above the lower polishing plate 32 and capable of being moved upward and downward and whose lower face is a polishing face.

The lower and upper polishing plates 32 and 36 are rotated, by a plate driving unit 40, about their axial lines, in the opposite rotational directions. Namely, the upper polishing plate 36 is rotated, by the plate driving unit 40 located on a base member 38, about its axial line. Further, the polishing plate 36 can be moved upward and downward. For example, the plate driving unit 40 has a vertical driving unit (not shown), e.g., cylinder unit. The lower polishing plate 32 is rotated, by a motor 42, about its axial line.

Carriers 44, each of which has through-holes for holding wafers, are provided between the lower polishing plate 32 and the upper polishing plate 36. The carriers 44 are engaged with a sun gear (inner pin gear) 46 and an internal gear (outer pin gear) 48, so that the carriers 44 are rotated about their own axes and moved around the sun gear 46 (see FIG. 2). The sun gear 46 and the internal gear 48 are rotated by a known mechanism (not shown).

A rotary plate 52 is located above the upper polishing plate 36 and connected to the upper polishing plate 36 by rods 50. With this structure, the rotary plate 52 is rotated together with the upper polishing plate 36.

A plurality of ring-shaped ducts (two ducts 54 and 56 are shown in FIG. 1) are coaxially fixed on the rotary plate 52.

Slurry holes 60, through which slurry is introduced downward, are opened in bottom faces of the ring-shaped ducts 54 and 56.

The slurry is supplied from a slurry supply source 64 to the ring-shaped ducts 54 and 56 via a pipe 62. A flow volume control valve 66 is provided to a mid part of the pipe 62.

Firstly, the slurry is introduced from the pipe 62 to pipes 70, which are respectively erected from arms 68. Further, the slurry is introduced from the pipes 70 to the ring-shaped ducts 54 and 56 via distribution tubes (not shown). The arms 68, etc. are attached to the base member 38 by known means (not shown).

Slurry holes 76 for introducing the slurry downward are formed in the upper polishing plate 36. The slurry holes 76 are radially arranged and equally spaced. The slurry holes of the upper polishing plate 36 are communicated to the slurry holes 60 of the ring-shaped ducts 54 and 56 by supply pipes 78. The slurry is supplied onto the polishing face of the lower polishing plate 32 via the supply pipes 78.

From the inner ring-shaped duct 54 of the coaxially arranged ducts, the slurry is supplied to three of the slurry holes 76 of the upper polishing plate 36, which are located on the inner side, so that the slurry is supplied to an inner zone of the polishing face of the lower polishing plate 32.

From the outer ring-shaped duct 56 of the coaxially arranged ducts, the slurry is supplied to three of the slurry holes 76 of the upper polishing plate 36, which are located on the outer side, so that the slurry is supplied to an outer zone of the polishing face of the lower polishing plate 32.

The slurry which has downwardly flown out from the lower polishing plate 32 is returned to the slurry supply source 64 via a collecting duct 80 and a return pipe 82 for reuse.

Note that, the slurry supply mechanism is not limited to the above described mechanism including the ring-shaped ducts. Many types of supply mechanisms may be employed.

Figure 2:
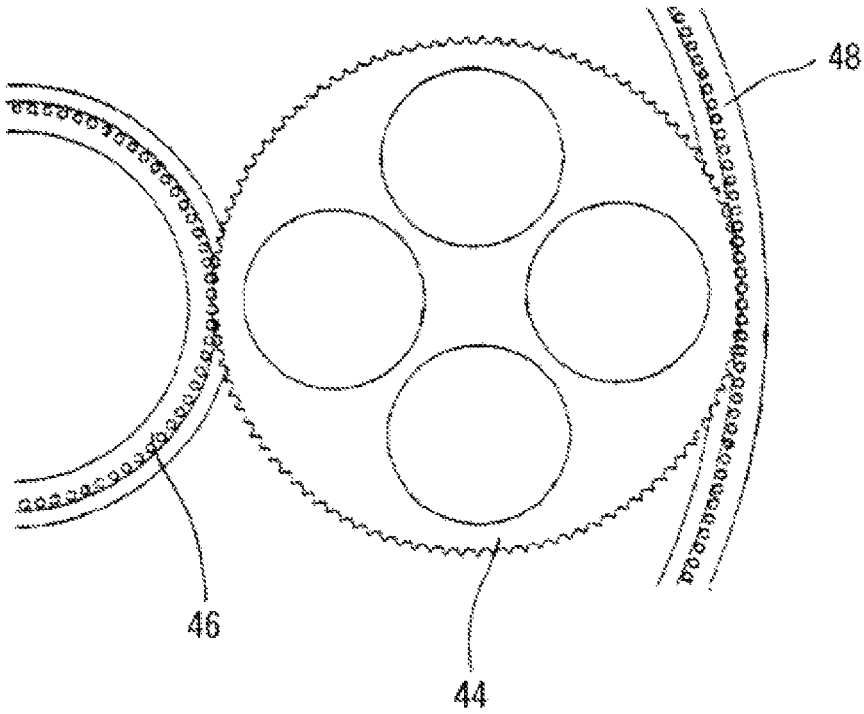
FIG. 2 is an explanation view of an ordinary carrier.

Next, the carrier 44 relating to the present invention will be explained. Note that, the carrier 44 shown in FIG. 2 is an ordinary carrier.

Figure 3:
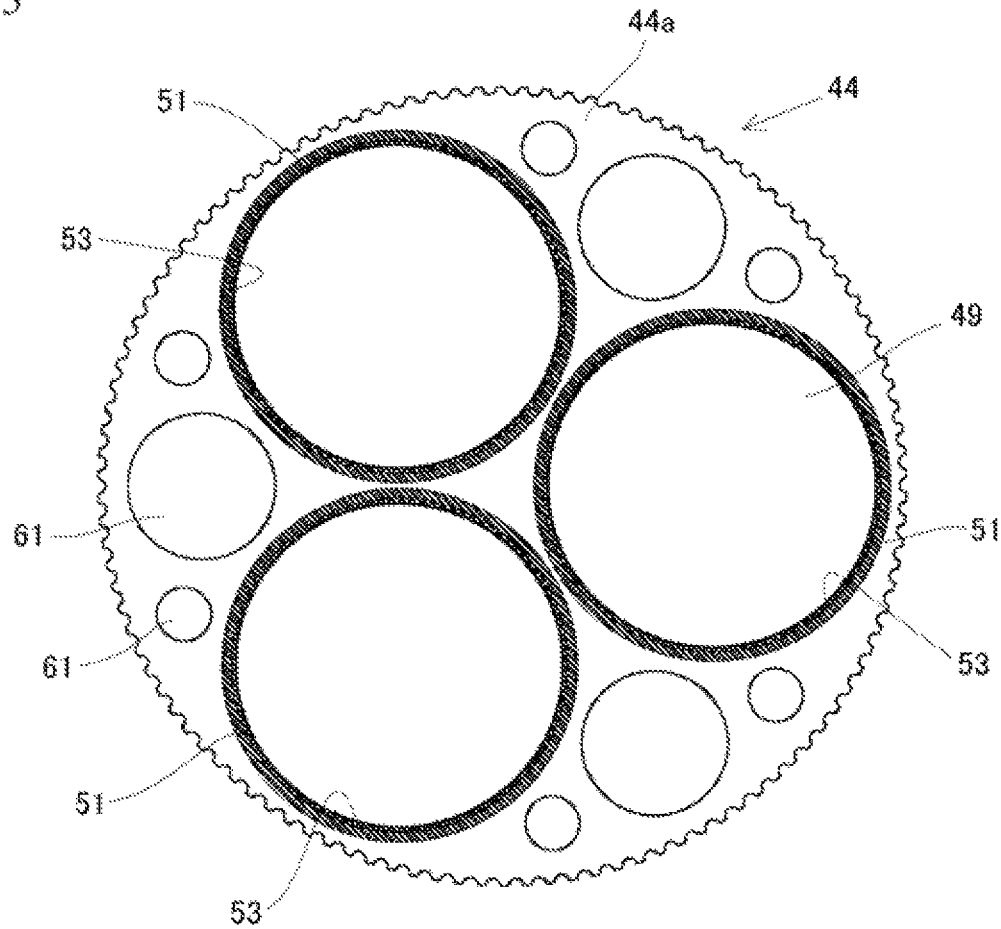
FIG. 3 is a plan view of an example of the carrier relating to the present invention.

FIG. 3 is a plan view of the carrier 44 relating to the present invention.

Figure 6:
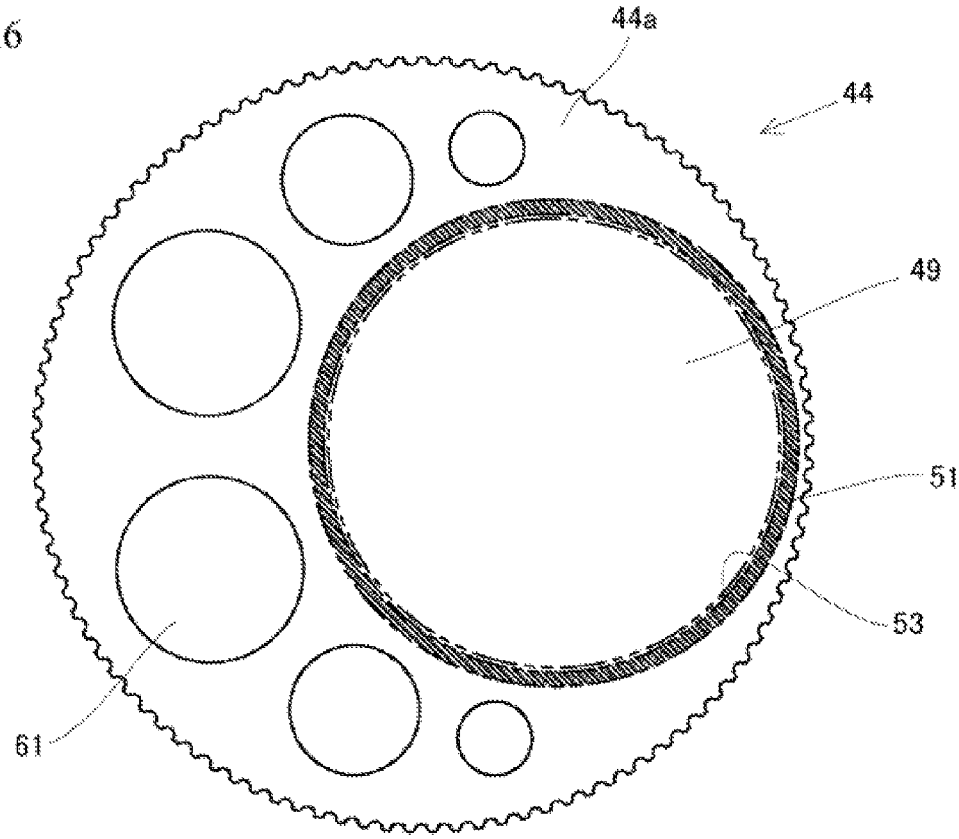
FIG. 6 is a plan view of another example of the carrier relating to the present invention.

The carrier 44 of the present embodiment has a main body part 44*a*, in which three through-holes 49 are formed and equally spaced in the circumferential direction. Semiconductor wafers 55 (see FIG. 4) are respectively held in the through-holes 49. Note that, number of the through-holes 49 is not limited. An example shown in FIG. 6, the carrier 44 has one through-hole 49.

In FIG. 3, slurry holes 61, through which slurry is introduced downward, are formed in the carrier 44.

Edge parts of each through-hole 49, which are formed in an upper face and a lower face of the main body part 44*a* of the carrier 44, are coated with coating layers 51, which are composed of an abrasion-resistant material and which have a prescribed width and a prescribed thickness.

The main body part 44*a* of the carrier 44 is composed of metal, e.g., stainless steel. A suitable material of the coating layers 51 is diamond-like carbon (DLC).

The DLC layers (films) may be formed by, for example, a plasma chemical vapor deposition (CVD) method (see, for example, Japanese Laid-open Patent Publication No. 2005-254351A). The plasma CVD method is a known method, so explanation will be omitted. Hardness of the DLC films is as high as that of diamond. Further, the DLC films have superior friction and low abrasion coefficient that diamond does not have. Therefore, by forming the DLC films in the main body part 44*a* of the carrier 44, abrasion of the main body part 44*a* can be restrained, so that a span of life of the carrier 44 can be extended.

Besides DLC, the coating layers 51 may be composed of other abrasion-resistant materials, e.g., hard ceramic.

A thickness of the main body part 44*a* is nearly equal to that of the finished wafer 55, e.g., 0.7-0.8 mm.

A suitable thickness of the coating layers 51 is about 2 μm. Further, a width of the coating layers 51 is about 8-15 mm, preferably 10 mm.

Note that, the size of the wafers 55 is 8-12 inches.

In the present embodiment, resin cushion rings 53, whose thickness is equal to that of the main body part 44*a* of the carrier 44 and whose width is 3-6 mm, preferably 5 mm, are respectively attached to inner circumferential faces of the through-holes 49. An inner diameter of the cushion rings 53 is slightly larger than a diameter of the wafers 55. The wafers 55 are respectively held in the cushion rings 53 (see FIG. 4).

A material of the cushion rings 53 is not limited. In the present embodiment, the cushion rings 53 are composed of epoxy resin.

The material of the cushion rings 53 is softer than metals, so that the cushion rings 53, which work as buffer materials, are capable of preventing outer edges of the wafers 55 from being damaged.

Preferably, the cushion rings 53 are detachably and exchangeably attached to the inner circumferential faces of the through-holes 49. The cushion rings 53 are composed of resin, so the cushion rings 53 have greater tendency to be abraded than the main body part 44*a* of the carrier 44.

Figure 5:
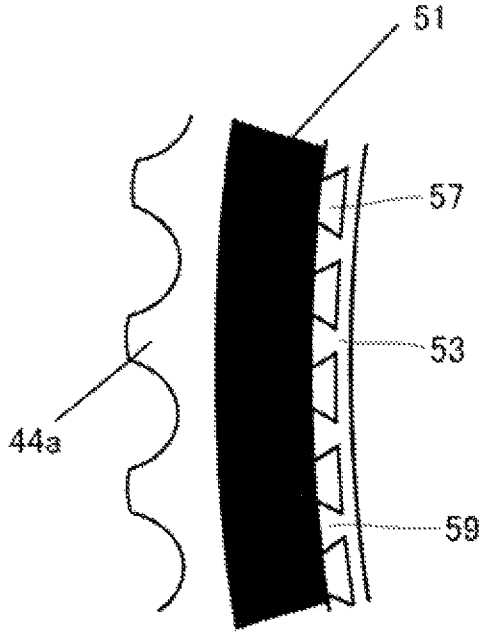
FIG. 5 is an explanation view of installation structure of a cushion ring.

To detachably attach the cushion ring 53, as shown in FIG. 5, inverted trapezoid projections 57, in each of which width is gradually increased inward, are projected from the inner circumferential face of the through-hole 49. On the other hand, inverted trapezoid projections 59, each of which can be fitted in a space between the adjacent projections 57 or engaged with the projection(s) 57, are projected from the outer circumferential face of the cushion ring 53. By mutually engaging the projections 57 and 59, the cushion ring 53 can be detached from the through-hole 49. Note that, in some cases, the cushion rings 53 may be adhered onto the inner circumferential faces of the through-holes 49 by an adhesive.

In the present embodiment, the wafers 55 are held in the through-holes 49 of the carrier 44 and the both sides of the wafers 55 are polished.

The polishing operation is stopped when the thickness (d) of the wafer 55 reaches a prescribed thickness range. The thickness range is from a thickness (d1) equal to that of the main body part 44*a* of the carrier 44 (=that of the cushion ring 53) to a thickness (d2) equal to a distance between the coating layer 51 in the upper face of the main body part 44*a* and the coating layer 51 in the lower face thereof (see FIG. 4). Namely, the thickness range is $d1 \leqq d \leqq d2$.

By setting the ending point of the polishing operation as described above, the wafers can be flatly polished without rounding outer edge parts.

Conventionally, polishing cloth polishes an outer circumferential face of a wafer, so an outer edge of the wafer will be rounded. On the other hand, a center part of the wafer will be over-polished and made thinner than the outer edge part thereof.

Figure 7:
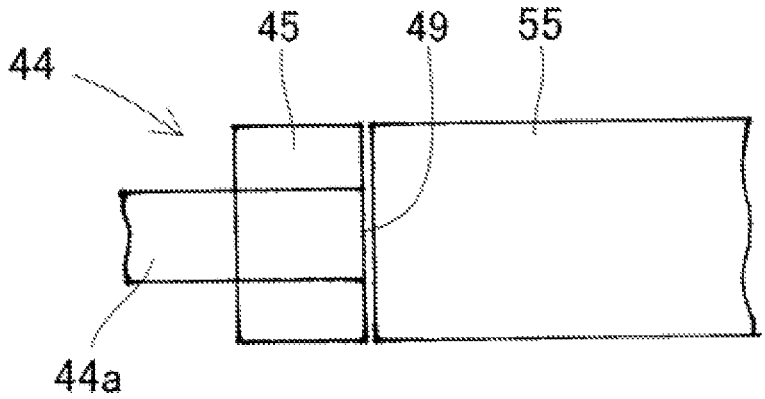
FIG.7 PRIOR ART
FIG. 7 is an explanation view showing a wafer held by a conventional carrier.

According to Japanese Laid-open Patent Publication No. 11-254305A, as shown in FIG. 7, a thickness adjusting member 45 is provided to an edge part of a through-hole 49 of a carrier 44 so as to make the edge part thicker than a main body part 44*a* of the carrier 44. With this structure, a thickness of a finished wafer 55 can be adjusted.

However, in FIG. 7, the wafer 55 is located just inside of the thickness adjusting member 45, so the outer edge part of the wafer 55 is less polished than the center part thereof. Therefore, the outer edge part will be too thick, so flatness of the finished wafer 55 must be bad.

In the present embodiment, the cushion ring 53 is provided between the coating layer 51, which corresponds to the thickness adjusting member of the conventional technology, and the outer edges (the upper outer edge and lower outer edge) of the wafer 55, so that rounding the outer edges of the wafer 55, which is caused by the polishing cloth, and erecting the outer edges thereof, which is caused by the coating layers 51, are mutually cancelled. Therefore, the wafer 55 can be highly flatly polished without rounding the outer edges.

Figure 4:
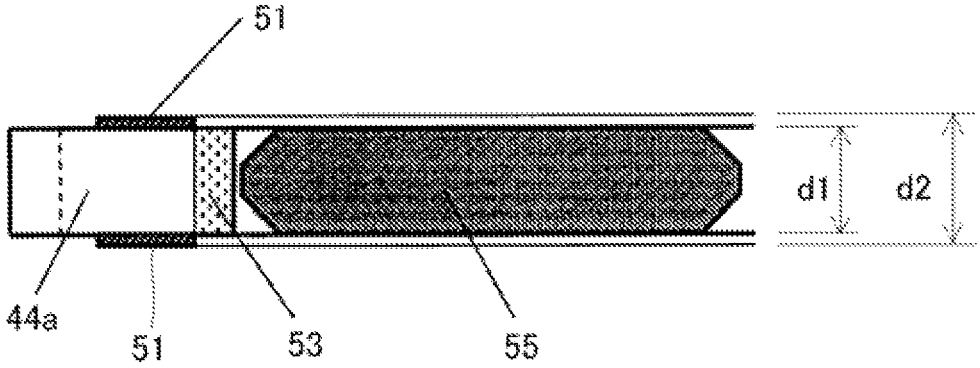
FIG. 4 is an explanation view showing a relationship between a carrier and a finished wafer.

Further, it is found that the wafer 55 can be uniformly polished even if the ending point of polishing wafer 55 is set in the thickness range d1-d2 (see FIG. 4). Therefore, the ending point of the polishing operation can be easily managed. Even if the thickness of the finished wafer 55 is between d1 and d2, the wafer 55 can be flatly polished. The reason is that the cushion ring 53, whose thickness is equal to the thickness (d1) of the main body part 44*a* of the carrier 44 and is thinner than the distance (d2) between the coating layers 51 in the upper and lower faces of the main body part 44*a* and whose width is about 3-6 mm, is provided between the coating layers 51 and the outer edges of the wafer 55, we think.

Figure 8:
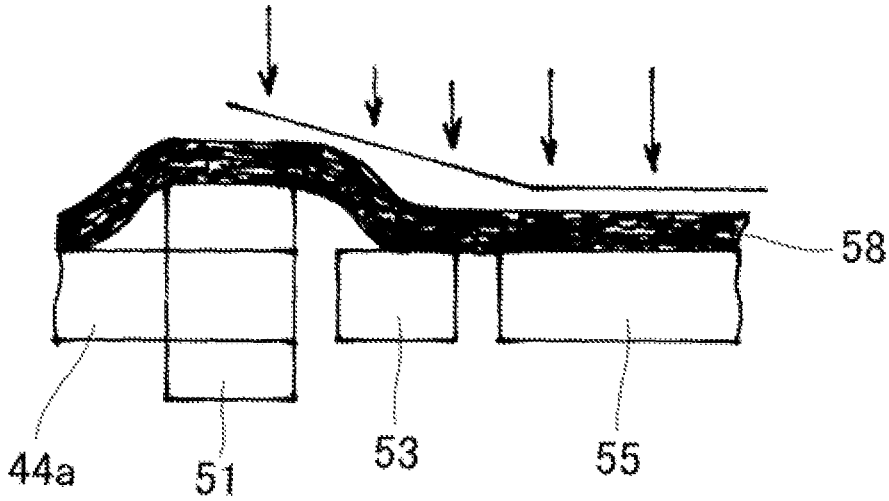
FIG. 8 is an explanation view showing the wafer held by the carrier of the present invention.

FIG. 8 shows distribution of a pressing force applied from polishing cloth 58 to the wafer 55 held in the cushion ring 53. By employing the cushion ring 53 having the prescribed width, the pressing force is evenly applied from the polishing cloth 58 to the entire surface of the wafer 55.

Further, by employing the cushion ring 53, damaging the upper and lower edges of the wafer 55 can be highly prevented.

By forming the coating layers 51 having high abrasion resistance, the span of life of the carrier 44 can be extended.

The coating layers 51 work as stoppers for restraining abrasion of the cushion ring 53 which works as a retainer. By restraining abrasion of the cushion ring 53, frequency of exchanging the cushion ring 53 can be lessened, and cost of the polishing operation can be reduced.

Since the coating layers 51 are formed in the limited parts of the main body part 44*a* of the carrier 44 except the cushion ring 53, the pin gears, etc., the coating layers 51 can be highly prevented from being peeled, so that damaging the wafer 55 can be prevented.

Another example of the carrier 44 will be explained with reference to FIGS. 9 and 10.

Figure 9:
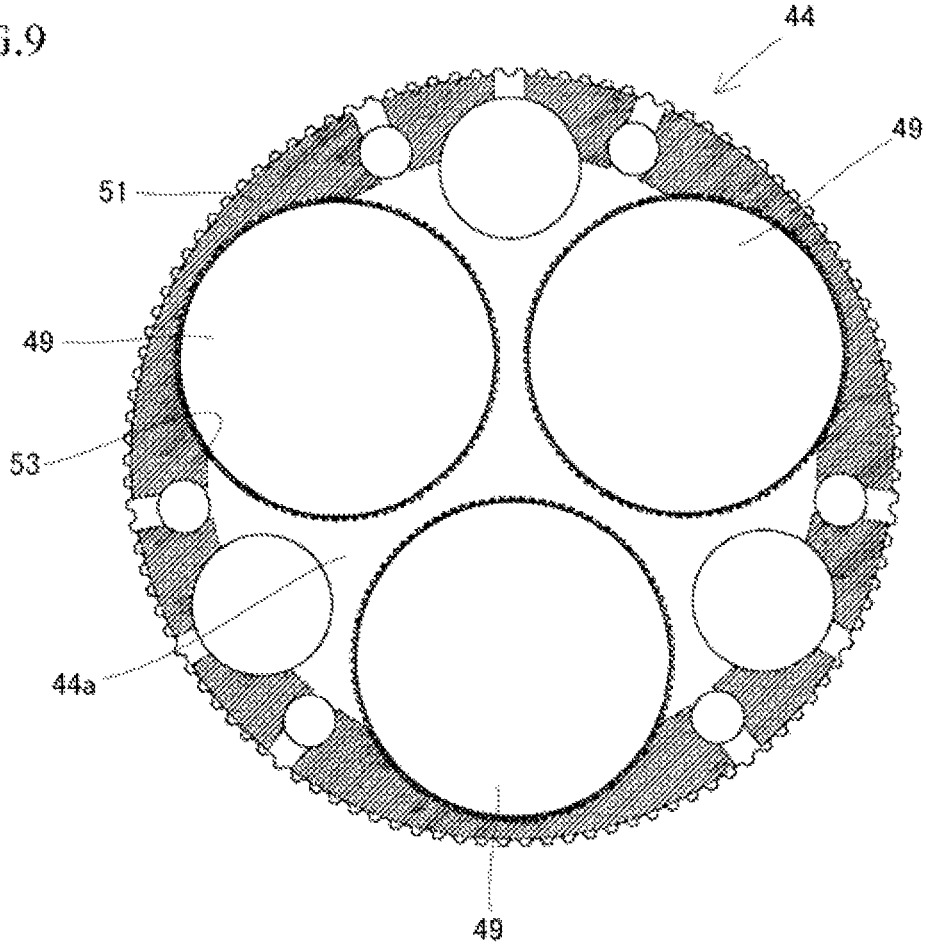
FIG. 9 is a plan view of further example of the carrier of the present invention.
Figure 10:
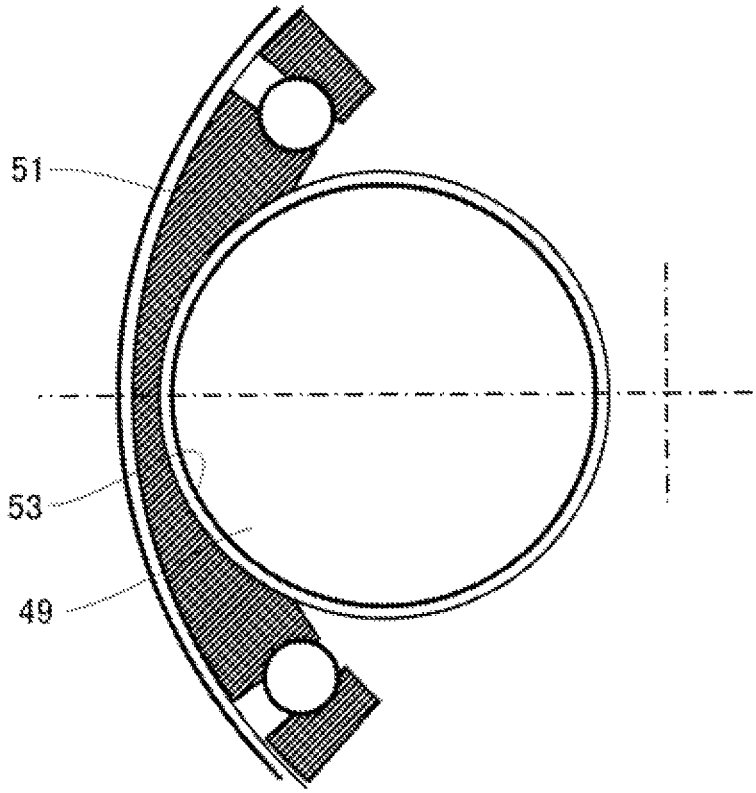
FIG. 10 is a partial enlarged view of the carrier shown in FIG. 9.

In the example shown in FIGS. 9 and 10, a plurality of the through-holes 49 (three through-holes 49 are shown in FIG. 9) are equally spaced in the circumferential direction of the main body part 44*a* of the carrier 44, and a part of the edge of each through-hole 49 is close to an outer edge part of the main body part 44*a*. The upper edge part (shaded part) and the lower edge part (not shown) of the carrier 44, which include the close parts of the edges of the through-holes 49, are coated with the coating layers 51, which are composed of the abrasion-resistant material and which have a prescribed width and a prescribed thickness. Note that, the upper edge part (shaded part) is formed in the upper face of the main body part 44*a*, and the under edge part (not shown) is formed in the lower face of the main body part 44*a*.

Preferably, the coating layers 51 are composed of DLC as well as the example shown in FIG. 3.

A suitable thickness of the coating layers 51 is about 2 μm, and a suitable width thereof is about 50 mm.

Note that, the through-holes 49 of the present example are used for holding the wafers 55 having a diameter of about 8 inches.

The resin cushion rings 53, whose thickness is equal to that of the main body part 44*a* and whose width is about 3-6 mm, are respectively provided to the inner circumferential faces of the through-holes 49 as well as the example shown in FIG. 3. The wafers 55 are respectively held in the cushion rings 53.

In the example shown in FIGS. 9 and 10, the coating layers 51 are not formed around the entire edges of the through-holes 49. However, the coating layers 51 are formed in the entire outer edge parts (the upper edge part and lower edge part) of the main body part 44*a* of the carrier 44, and the coating layers 51 include the close parts of the edges of the through-holes 49. The coating layers 51 are wide, e.g., 50 mm. Further, the cushion rings 53, whose thickness is equal to the thickness of the main body part 44*a* of the carrier 44 and is thinner than the distance between the coating layers 51 in the upper and lower faces of the main body part 44*a*, are provided to the inner circumferential faces of the through-holes 49. With this structure, this example can obtain the effect of uniformly polishing the wafers 55 as well as the example shown in FIG. 3.

Further, damaging the edge parts of the wafers 55 can be prevented, and a span of life of the carrier 44 can be extended.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention has been described in detail, it should be understood that the various changes, substitutions, and alternations could be made hereto without departing from the spirit and scope of the invention.

What is claimed is:

1. A method of polishing both sides of a wafer in a double-side polishing apparatus comprising:

a lower polishing plate having an upper face, on which a first polishing cloth is adhered;

an upper polishing plate being provided above said lower polishing plate and capable of being moved upward and downward, said upper polishing plate having a lower face, on which a second polishing cloth is adhered;

a carrier being provided between said lower polishing plate and said upper polishing plate, said carrier having a main body part, in which at least one through-hole for holding a wafer is formed;

a plate driving unit for rotating said lower polishing plate and said upper polishing plate about their axial lines;

a carrier driving unit for rotating said carrier; and a slurry supply source, wherein said lower polishing plate, said upper polishing plate and said carrier are rotated, with supplying slurry onto said lower polishing plate, so as to polish both sides of the wafer which is sandwiched between said lower polishing plate and said upper polishing plate;

edges of the at least one through-hole in an upper face and a lower face of said carrier are coated with diamond-like carbon (DLC) coating layers, which have a prescribed width and a prescribed thickness;

a resin cushion ring, which has a prescribed width and whose thickness is equal to that of the main body part of said carrier, is provided to an inner circumferential face of the at least one thorough-hole, and the wafer is held in said resin cushion ring, said method comprising:

stopping a polishing operation when the thickness of the wafer reaches a prescribed thickness range, which is from a thickness equal to that of the main body part of said carrier to a thickness equal to a distance between the coating layer in the upper face of the main body part and the coating layer in the lower face thereof.

2. A method of polishing both sides of a wafer in a double-side polishing apparatus comprising:

a lower polishing plate having an upper face, on which a first polishing cloth is adhered;

an upper polishing plate being provided above said lower polishing plate and capable of being moved upward and downward, said upper polishing plate having a lower face, on which a second polishing cloth is adhered;

a carrier being provided between said lower polishing plate and said upper polishing plate, said carrier having a main body part, in which a plurality of through-holes for holding wafers are formed;

a plate driving unit for rotating said lower polishing plate and said upper polishing plate about their axial lines; a carrier driving unit for rotating said carrier; and a slurry supply source, wherein said lower polishing plate, said upper polishing plate and said carrier are rotated, with supplying slurry onto said lower polishing plate, so as to polish both sides of the wafers which are sandwiched between said lower polishing plate and said upper polishing plate; the plurality of through-holes are equally spaced in the circumferential direction of said carrier, and a part of an edge of each through-hole is close to an edge of the main body part of said carrier; a lower edge part and an upper edge part of said carrier, which include the parts of the edges of the plurality of through-holes, are coated with diamond-like carbon (DLC) coating layers, which have a prescribed width and a prescribed thickness; resin cushion rings, which have a prescribed width and whose thickness is equal to that of the main body part of said carrier, are respectively provided to inner circumferential faces of the plurality of thorough-holes; and the wafers are respectively held in said resin cushion rings, said method comprising:

stopping a polishing operation when the thickness of the wafers reach a prescribed thickness range, which is from a thickness equal to that of the main body part of said carrier to a thickness equal to a distance between the coating layer in the upper face of the main body part and the coating layer in the lower face thereof.

* * * * *